United States Patent [19]

Tootle

[11] Patent Number: 4,485,725

[45] Date of Patent: Dec. 4, 1984

[54] ACTUATOR SYSTEM INCLUDING HYDRAULICALLY SYNCHRONIZED ACTUATORS

[75] Inventor: James N. Tootle, Kalamazoo, Mich.

[73] Assignee: Pneumo Corporation, Boston, Mass.

[21] Appl. No.: 377,984

[22] Filed: May 13, 1982

[51] Int. Cl.[3] ..... F15B 15/26; F15B 11/22

[52] U.S. Cl. ..... 91/45; 91/417 R; 91/515; 92/33

[58] Field of Search ..... 91/515, 44, 45, 417 R; 92/17, 33

[56] References Cited

U.S. PATENT DOCUMENTS

| | | | |
|---|---|---|---|
| 2,688,232 | 9/1954 | Geyer | 92/17 |
| 3,296,936 | 1/1967 | Weiss et al. | 91/49 |
| 3,359,862 | 12/1967 | Madrich | 91/44 |
| 3,481,489 | 12/1969 | Stauffer | 91/515 |

FOREIGN PATENT DOCUMENTS

| | | | |
|---|---|---|---|
| 1582264 | 1/1978 | United Kingdom . | |
| 496381 | 3/1976 | U.S.S.R. | 91/515 |
| 535426 | 11/1976 | U.S.S.R. | 91/515 |

*Primary Examiner*—Paul E. Maslousky

*Attorney, Agent, or Firm*—Maky, Renner, Otto & Boisselle

[57] ABSTRACT

An actuator system characterized by parallel connected flow regulator valves for controlling the flow of fluid to and from the extend ends of a corresponding number of fluid actuators. Retract orifices in the fluid lines leading to the retract ends of the actuators prevent cavitation of the extend ends of the actuators under an aiding air load pulling the actuators out during extension thereof.

12 Claims, 3 Drawing Figures

ACTUATOR SYSTEM INCLUDING HYDRAULICALLY SYNCHRONIZED ACTUATORS

This invention relates generally as indicated to an actuator system including hydraulically synchronized actuators, and more particularly, to such a system in which a flow control valve provides for controlled hydraulic synchronous actuation of two or more actuators.

BACKGROUND OF THE INVENTION

Heretofore, it has been common practice to mechanically synchronize two or more fluid actuators by providing a power transmitting connection therebetween. Such mechanical synchronization systems have proven to be very effective in synchronizing the operation of two or more actuators so that if one actuator is overloaded and another is underloaded, the underloaded actuator will assist the overloaded actuator. However, it is still necessary to provide separate hydraulic controls for controlling the rate of movement of the actuators during both the deploy and stow cycles.

SUMMARY OF THE INVENTION

In contradistinction to known actuator systems of the aforementioned type, the actuator system according to the present invention utilizes a flow control valve for controlling the flow of fluid to and from the extend ends of two or more actuators to provide controlled hydraulic synchronous actuation thereof. The flow control valve includes parallel connected flow regulator valves which are connected to the extend ends of the respective actuators.

During both the deploy and stow cycle, the flow regulators control the speed of the actuators by controlling the flow of fluid through the regulators. When the rated velocity of the actuators is reached, the flow regulators will restrict the actuators from further acceleration by reducing the pressure available while maintaining a substantially constant flow of fluid to or from the actuators for controlled synchronous operation thereof. When the actuators are deploying, each regulator is set for a nominal flow limit which will ordinarily be greater than the nominal flow limit during the stow cycle.

In accordance with the present invention, the actuator system includes two or more sets of actuators, each set desirably consisting of at least one locking actuator and one or more non-locking actuators. The flow regulators control the flow of fluid to sequence-power valves associated with the respective locking actuators. The fluid entering the sequence-power valves from the flow regulators operates a lock piston first to release the lock mechanism and then to port the fluid to the extend sides of all of the actuators of each set.

Still in accordance with the invention, an extend orifice is desirably provided in the extend passage from the lock piston to the extend end of the locking actuator to prevent the external pressure upstream of the sequence-power valve from dropping below a predetermined level so that the lock piston will not cycle during extension of the actuator. All of the actuators of each set may be mechanically synchronized both in position and motion by providing a power transmitting connection therebetween.

Further in accordance with the invention, the flow control valve includes a retract orifice in the fluid lines which supply pressure to the retract ends of the actuators to prevent cavitation of the extend ends of the actuators under an aiding air load pulling the actuators out during the deploy cycle.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

BRIEF DESCRIPTION OF THE DRAWINGS

In the annexed drawings

DETAILED DESCRIPTION OF THE PREFERRED EMBODIMENT

Figure 1:
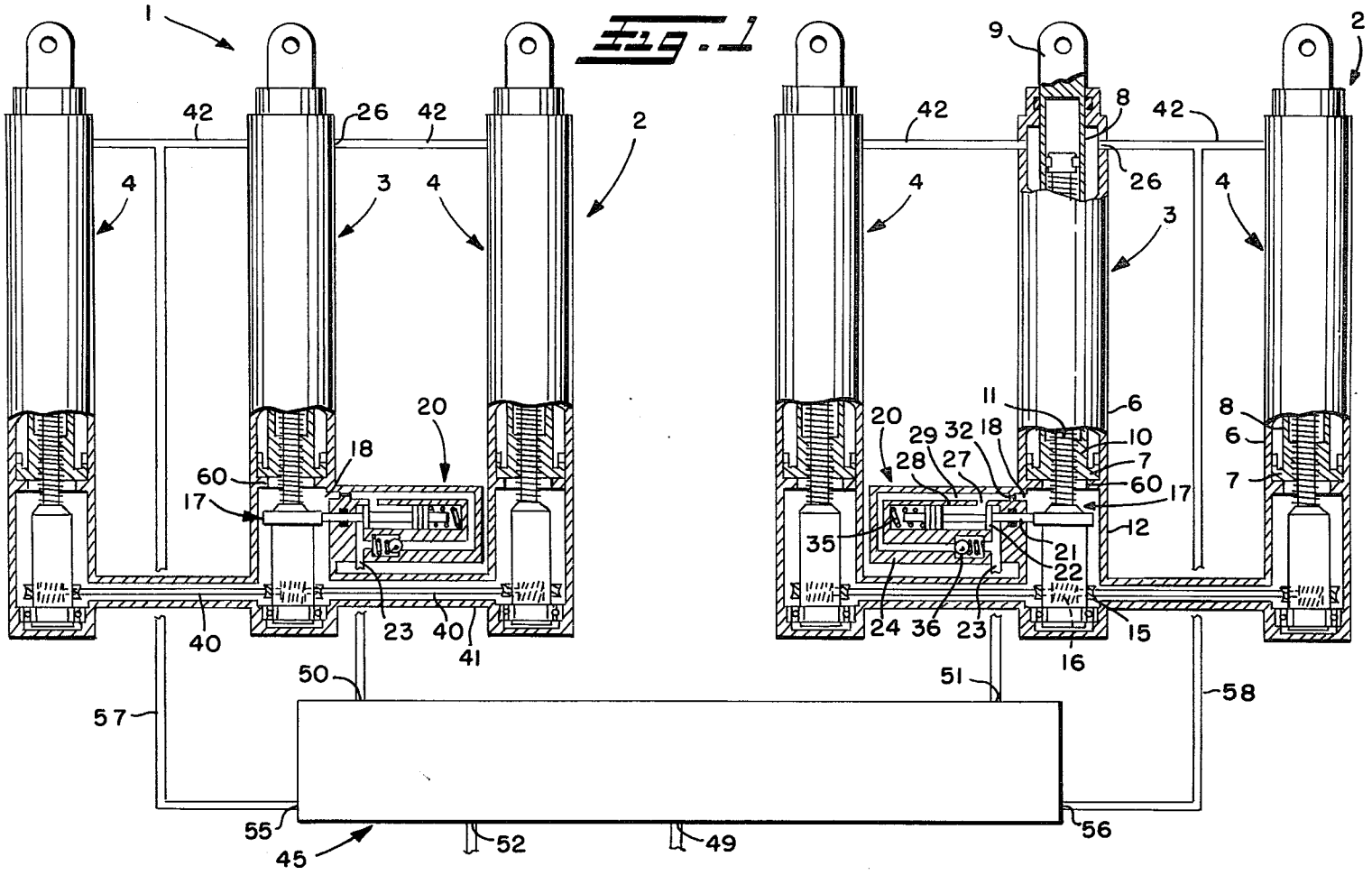
FIG. 1 is a schematic illustration of a preferred form of actuator system in accordance with the present invention including two sets of actuators and a flow control valve for providing controlled hydraulic synchronous actuation of both sets of actuators.

The fluid actuator system of the present invention is designated generally by the reference numeral 1 in FIG. 1, and desirably includes two sets of actuators, each set being designated generally by reference numeral 2. Each set may, for example, be used for the controlled positioning of each half of a translating cowl or C duct of a jet engine of an aircraft to provide for reverse thrust of the engine to assist in braking of the aircraft. While the number of actuators in each set may vary, in the embodiment illustrated herein, each set consists of three actuators, one of which is desirably a locking actuator 3 and the other two are non-locking actuators 4.

The locking actuators 3 are preferably of identical construction, and may be of the type disclosed in copending U.S. application Ser. No. 352,046, filed Feb. 24, 1982, the disclosure of which is incorporated herein by reference. Briefly, each such locking actuator includes a cylinder 6 containing a piston 7 axially movable therein. Attached to the piston is a hollow rod 8 which extends through the rod end of the cylinder and has a rod end assembly 9 on its outboard end to facilitate connection to the movable part of the device to be actuated. A suitable trunnion mount may also be provided on the cylinder to facilitate connection to the other part of the device to be actuated.

The piston has a high lead Acme nut 10 in the center thereof which is coupled to a mating Acme screw shaft 11. One end of the screw shaft may be journaled in suitable bearings within the actuator housing 12 adjacent the inboard end of the actuator, whereas the other end of the screw shaft extends into the hollow piston rod a substantial distance beyond the nut. As the piston moves back and forth in the cylinder, the screw shaft rotates at a speed proportional to the velocity of the piston.

The screw shaft has a high lead worm wheel 15 attached thereto which mates with a worm shaft 16 mounted for rotation within a transverse bore in the actuator housing.

When the locking actuators 3 are in the retracted or stowed position shown in FIG. 1, such actuators may be locked in such position by a suitable lock mechanism 17, the details of which are not shown, but may, for example, be of the type disclosed in the aforementioned copending application Ser. No. 352,046.

Before the locking actuators can be extended, the associated lock mechanisms must be released and then system pressure must be applied to the extend ports 18 of such actuators. In each of the locking actuators disclosed herein, both such functions are desirably accomplished by actuation of associated sequence-power valves 20 which may also be of the type disclosed in the aforementioned copending application. As schematically illustrated in FIG. 1, each such sequence-power valve includes a lock release lever 21 which, when in the position shown, permits the lock mechanism 17 to perform its normal locking function when the respective locking actuator piston reaches its fully retracted position. To release the lock mechanism, a lock piston 22 is provided which is responsive to fluid pressure being supplied to a lock-in port 23 in the sequence-power valve housing 24 to cause the lock release lever to move to a lock disengaging position.

Before system pressure is admitted to the lock-in port for effecting release of the lock mechanism 17, system pressure is desirably applied to the retract end of the locking actuator through a retract port 26 to remove any axial tension loads on the actuator which might otherwise interfere with release of the lock. Then, with system pressure still applied to the retract port, system pressure is also applied to the lock-in port 23 to release the lock mechanism as previously described.

After the lock piston 22 has moved far enough to release the lock mechanism, the system pressure acting on the lock piston is ported to the extend end of the actuator through a port 27 in the lock piston bore 28 which is uncovered by the lock piston following such movement. Port 27 communicates with the extend port 18 through an extend passage 29 in the sequence-power valve housing. Since the area of the actuator piston 7 exposed to the extend pressure is greater than that exposed to the retract pressure, the actuator will extend. An extend orifice 32 in the extend passage 29 prevents the external pressure at the lock-in port 23 from dropping below a predetermined level so that the lock piston 22 will not cycle during extension of the actuator.

To retract the actuator, the pressure acting on the extend end of the actuator is reduced, as by connecting the lock-in port 23 to return pressure, while still maintaining system pressure on the retract end of the actuator. With reduced pressure at the lock-in port, a return spring 35 acting on the lock piston 22 will cause the lock piston to return to its original position blocking fluid flow from the extend end of the actuator through the lock piston bore 28. However, return flow from the extend end of the actuator still occurs through a check valve 36 in the passage 29 providing communication between the extend end of the actuator and the lock-in port.

With the lock piston 22 in its retracted position shown in FIG. 1, the lock release lever 21 will no longer be effective in maintaining the lock mechanism 17 in the unlocked condition. However, the construction of the lock mechanism is such that it will remain unlocked until the actuator piston bottoms out in the fully stowed position as shown and described in the aforementioned copending application.

The non-locking actuators 4 of each actuator set 2 may be substantially identical to the locking actuators 3 except that they do not include either the lock mechanism 17 or the sequence-power valve 20 for releasing the lock mechanism. Accordingly, the same reference numerals are used to designate like parts.

Each of the actuators 3, 4 of each set may be mechanically synchronized both in position and motion by connecting the worm shafts 16 of the actuators together by flex shafts 40 or the like as shown. The flex shafts are also desirably surrounded by sealed tubes 41 which provide flow paths between the extend ends of the actuators, whereby the same fluid pressure that is admitted to the extend ends of the locking actuators 3 through the sequence-power valves 20 will also be admitted to the extend ends of the non-locking actuators 4, but not until after the lock mechanisms of the locking actuators have been released as previously described. This assures that the extend pressure will be simultaneously applied to the extend ends of the actuators of each set, but not before the associated lock mechanisms have been released. The retract ends of all of the actuators of each set are also desirably interconnected by hydraulic conduits 42 to ensure that the same hydraulic pressure is also simultaneously applied thereto.

Figure 2:
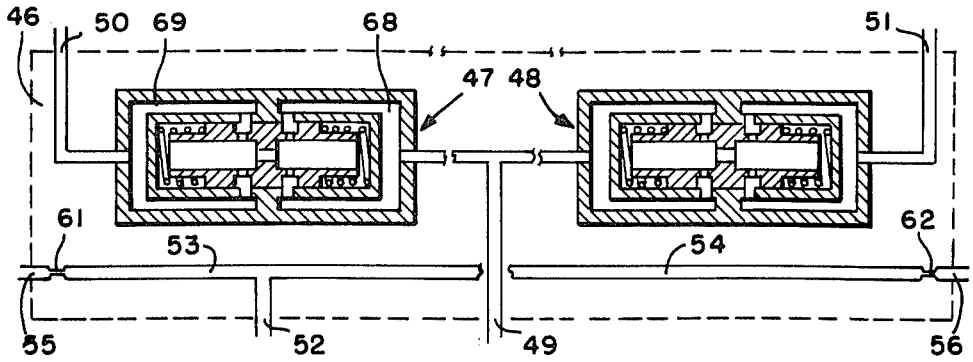
FIG. 2 is an enlarged schematic sectional view through the flow control valve of FIG. 1 showing the flow regulators and retract orifices which comprise such flow control valve.

If desired, both sets of actuators may also be mechanically synchronized by providing a flex shaft interconnecting the worm shafts of at least one actuator of each set. However, in the preferred form of actuator system 1 disclosed herein, a flow control valve generally identified by the reference numeral 45 is employed for hydraulically synchronizing at least one actuator of each set. As shown schematically in FIG. 2, such flow control valve includes a housing 46 containing two bidirectional flow regulator valves 47, 48 connected in parallel to a common fluid pressure inlet port 49, and each having its own respective outlet port 50, 51 in the flow control valve housing for connection to the lock-in port 23 of the respective locking actuator with which it is associated. As will be more fully described hereafter, such flow regulator valves precisely limit the flow of fluid to each actuator set during the deploy cycle to synchronize the rate at which each actuator set extends while ensuring that a minimum amount of flow is taken from the aircraft's system by limiting the maximum actuator speed.

A second pressure inlet port 52 may also be provided in the flow control valve housing 46 for supplying system pressure to a pair of parallel connected passages 53, 54 extending between the inlet port 52 and two additional outlet ports 55, 56 in the housing. As shown in FIG. 1, the outlet ports 55, 56 are connected to one of the conduits 42 between the retract ends of the actuators of each set through suitable fluid lines 57, 58, respectively.

When the pilot desires to deploy the actuator system, he first connects the pressure side of the aircraft hydraulic system to the pressure port 52 in the flow control valve housing 46 to supply pressure to the retract ends of the actuators through the outlet ports 55, 56 to make certain that the pistons 7 of the locking actuators 3 are seated firmly on the stow stops 60 within the respective actuator cylinders 6, which unloads the lock mechanisms.

The actuators will remain in the stowed position until the pilot supplies system pressure to the port 49 of the flow control valve 45. Such applied pressure causes fluid to flow through the flow regulator valves 47, 48 to the respective lock-in ports 23 of the sequence-power valves 20, first to unlock the locking actuators 3, and then to pressurize the extend cavities of all of the actuators 3, 4 of each set. Although there will then be system pressure on both sides of the actuator pistons, the actuators will extend because of the unbalanced areas of the pistons as aforesaid.

Because of the low inertia of the actuator system, the actuators will accelerate rapidly. When the rated velocity of the actuators is reached, the flow regulator valves 47, 48 will effectively restrain the system from further acceleration by reducing the extend pressure available while maintaining a substantially constant flow of fluid to the actuators.

To prevent cavitation of the extend ends of the actuators under an aiding air load pulling the actuators out during the deploy cycle, retract orifices 61, 62 are provided in each of the passages 53, 54 in the flow control valve housing 4, or otherwise this condition could result in loss of speed control. Also, as previously mentioned, an extend orifice 32 is provided in the passage 29 in each sequence-power valve housing between the lock piston 22 and the extend end of the locking actuator to prevent the external pressure that is supplied to the lock-in port 23 during the deploy cycle from dropping below a predetermined level which prevents the lock piston from cycling for all conditions where the specified minimum pressure from the aircraft's hydraulic system is met. The actuators will continue to extend until they are moved to the fully deployed position, and such actuators will remain fully deployed as long as system pressure is applied to the lock-in ports.

When the pilot desires to move the actuators to the stowed position, the port 49 and thus the lock-in ports 23 are connected to the aircraft return while system pressure is still maintained on the extend end of the actuators, thus causing the actuators to accelerate toward the stowed position. As in the opposite direction, the flow regulator valves 47, 48 will limit the maximum velocity of the actuators to specified limits. Since the flow requirements of the actuator system are normally different in the deploy and stow cycles, the flow regulator valves may have one flow requirement during deploy and another flow requirement during stow. In the usual case, the flow requirements are greater in the deploy cycle than in the stow cycle.

When the actuators attain their rated velocity, the flow regulators restrain the system from further acceleration by reducing the available extend pressure while maintaining a constant flow to the actuators. This reduction in extend pressure while maintaining flow provides hydraulic synchronization between both sets of actuators and minimizes the aircraft hydraulic system flow requirements.

Figure 3:
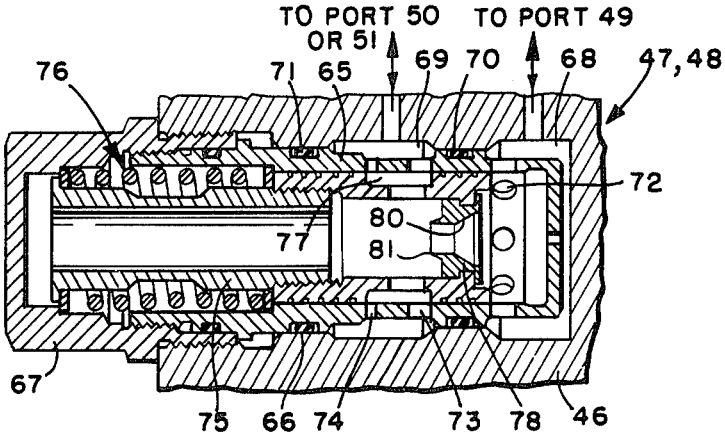
FIG. 3 is an enlarged longitudinal section through a preferred form of one such flow regulator for use in the actuator system of the present invention.

The details of a preferred form of one such flow regulator valve 47, 48 are shown in FIG. 3. Such flow regulator valve includes a porting sleeve 65 which is received in a bore 66 extending into the flow control valve housing 46 from one side thereof and retained in place as by an end cap 67 having a threaded connection both with the porting sleeve and bore wall. The bore 66 has a pair of axially spaced apart annular grooves 68, 69 respectively in fluid communication with the pressure inlet port 49 and one or the other ports 50, 51. The porting sleeve 65 has a pair of external seals 70, 71 which isolate the pressure grooves 68, 69 from each other except through longitudinally spaced passages 72–74 and a central passage in the porting sleeve.

Mounted for axial movement within the porting sleeve is a metering piston 75 which is normally retained in a centered position by a centering spring mechanism 76 at one end of the assembly. When thus centered, a metering groove 77 in the metering piston completely unblocks the metering passages 73, 74 in the porting sleeve, thus permitting unobstructed flow therethrough. Within the center of the metering piston is an orifice plate 78 through which fluid flows from one pressure groove 68, 69 to the other.

As long as the fluid flow through the regulator valve is within the prescribed limits set by the regulator, the metering piston 75 will remain in the centered position shown. However, as the flow in one direction increases, the pressure drop through the orifice 78 will increase, thus causing an imbalance of pressures on opposite ends of the metering piston, which results in a slight movement of the metering piston in the direction of the pressure drop to cause the metering groove 77 to reduce the flow through one or the other sets of metering passages 73, 74. Likewise, during flow of fluid in the opposite direction, as the flow through the orifice 78 increases, there will be an imbalance of pressure acting on the opposite ends of the metering piston causing movement of the metering piston in the opposite direction to meter the flow of fluid. The amount of fluid passing through the regulator can be controlled by the size of the metering passages 73, 74 in the porting sleeve 65 and orifice 78 in the metering piston 75.

As previously indicated, in the usual case the flow requirements are greater in the deploy cycle than in the stow cycle. Reduced flow in the stow direction may be achieved by locating the flow passages 72 closely adjacent the righthand end of the metering piston 75 as shown in FIG. 3 so that as the metering piston moves to the right during the stow cycle, the piston will partially restrict the flow through such passages. Also, the extent of movement of the metering piston 75 may be increased to further restrict (meter) the flow through the passages 72 and 74 by providing a greater resistance to flow through the flow regulator valve in the stow direction than in the deploy direction. In the form of flow regulator valve shown in FIG. 3, this is accomplished by providing the orifice plate 78 with a smooth chamfer 80 on the side closest to the inlet port 49 and a sharp edge 81 on the other side so that there is a greater resistance to flow through the orifice in the stow direction than in the deploy direction.

From the foregoing, it will now be apparent that the actuator system of the present invention provides a relatively simple and effective means for hydraulically synchronizing the movements of two or more actuators while controlling the flow of fluid to and from the extend ends of such actuators during extension and retraction thereof.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

The embodiments of the invention in which an exclusive property or privilege is claimed are defined as follows:

1. An actuator system comprising two sets of actuators, each set including a plurality of actuators, each said actuator including a cylinder and a reciprocable piston capable of fluid pressure actuation in either direction, means for mechanically synchronizing all of said actuators of each set both in position and motion, and a pair of parallel connected flow regulator means connected to the extend ends of one of said actuators of each set, said flow regulator means including means for limiting the flow of fluid to and from said extend ends of said one of said actuators of each set through said flow regulator means to synchronize the rate at which said one of said actuators of each set extend and retract, and means providing fluid communication between the extend ends of all of said actuators of each set whereby all of the flow to and from said extend ends of said actuators in each set is controlled by the same flow regulator means.

2. An actuator system as set forth in claim 1 further comprising passage means through which fluid pressure is supplied to the retract end of one of said actuators of each set, means for providing fluid communication between the retract ends of all of said actuators of each set, and retract orifice means through which fluid flows through said passage means to and from the retract ends of one of said actuators of each set for preventing cavitation of the extend ends of said actuators under an aiding air load pulling said actuators out during extension thereof.

3. An actuator system as set forth in claim 2 wherein there are two of said retract orifice means respectively connected to the passage means to the retract ends of said one of said actuators of each set.

4. An actuator system as set forth in claim 1 wherein said one actuator of each set is a locking actuator including lock means for releasably locking said locking actuator against movement, and means responsive to fluid pressure being supplied to said locking actuator through the respective flow regulator means first to release said lock means and then to supply such fluid pressure to the extend end of said locking actuator.

5. An actuator system comprising two sets of actuators, each set including a plurality of said actuators, each said actuator including a cylinder and a reciprocable piston disposed in said cylinder capable of fluid pressure actuation in either direction, means for mechanically synchronizing said actuators in each set both in position and motion, and flow control valve means for providing controlled fluid synchronous operation of said actuators, said flow control means including two parallel connected flow regulator means connected to the extend ends of one of said actuators of each set, said flow regulator means including means for limiting the flow of fluid to and from said extend ends of said one of said actuators of each set through said flow regulator means to synchronize the rate at which said actuators extend and retract, means providing fluid communication between the extend ends of all of said actuators of each set, whereby all of the flow to and from the extend ends of said actuators in each set is controlled by the same flow regulator means, passage means through which fluid pressure is supplied to the retract ends of said actuators of each set, means for providing fluid communication between the retract ends of all of said actuators of each set, two retract orifice means respectively connected to the passage means to the retract end of one of said actuators of each set through which fluid flows through said passage means to and from the retract end of one of said actuators of each set for preventing cavitation of the extend ends of said actuators under an aiding air load pulling said actuators out during extension thereof, said flow control valve means including a housing containing said flow regulator means, said housing having a first fluid pressure inlet port to which said flow regulator means are connected in parallel, and separate outlet ports for each of said flow regulator means respectively connected to the extend end of one of said actuators of each set, said housing also containing said orifice means, said housing having a second fluid pressure inlet port and a pair of parallel connected passages extending from said second fluid pressure inlet port to two additional outlet ports in said housing, said parallel connected passages containing said orifice means, and said additional outlet ports being connected to the respective retract ends of one of said actuators of each set.

6. An acutator system as set forth in claim 5 wherein said flow regulator means includes means for permitting a higher controlled rate of flow to said extend ends of said actuators than from said extend ends, whereby the rate at which said actuators extend will be greater than the rate at which said actuators retract.

7. An actuator system as set forth in claim 5 wherein said actuators to which said flow regulator means are connected are locking actuators, said locking actuators including lock means for releasably locking said locking actuators against movement, and means responsive to fluid pressure being supplied to said locking actuators through said flow regulator means first to release said lock means and then to supply such fluid pressure to the extend ends of said locking actuators.

8. An actuator system as set forth in claim 7 wherein said other actuators of each set are non-locking actuators.

9. An actuator system comprising a plurality of sets of actuators each set including a plurality of actuators each including a cylinder and a reciprocable piston disposed in said cylinder capable of fluid pressure actuation in either direction, means for mechanically synchronizing said actuators in each set both in position and motion, and flow control valve means for providing controlled fluid synchronous operation of one of said actuators of each set, said flow control valve means including a plurality of parallel connected flow regulator means corresponding in number to the number of sets of actuators and connected to the extend ends of said one of said actuators of each set, said flow regulator means including means for limiting the flow of fluid to and from said extend ends of said one of said actuators of each set through said flow regulator means to synchronize the rate at which one of said actuators of each set extend and retract, passage means through which fluid pressure is supplied to the retract ends of said actuators, means for providing a continuous supply of fluid to the retract ends of said actuators during extension thereof and retract orifice means through which such fluid flows through said passage means to and from the retract ends of said actuators for preventing cavitation of the extend ends of said actuators under and aiding air load pulling said actuators out during extension thereof.

10. An actuator system as set forth in claim 9 wherein said flow control valve means includes a housing containing said flow regulator means, said housing having a first fluid pressure inlet port to which said flow regulator means are connected in parallel, and separate outlet ports for each of said flow regulator means respectively connected to the extend ends of said actuators.

11. An actuator system as set forth in claim 10 wherein said housing also contains said retract orifice means, said housing having a second fluid pressure inlet port and a plurality of parallel connected passages extending from said second fluid pressure inlet port to a corresponding number of additional outlet ports in said housing, said parallel connected passages containing said retract orifice means, and said additional outlet ports being connected to the respective retract ends of said actuators.

12. An actuator system as set forth in claim 9 further comprising means providing fluid communication between the extend ends of all of said actuators of each set, whereby all of the flow to and from the extend ends of said actuators in each set is controlled by the same flow regulator means.

* * * * *